US006268325B1

(12) United States Patent
Luciani et al.

(10) Patent No.: US 6,268,325 B1
(45) **Date of Patent: *Jul. 31, 2001**

(54) CLEANING COMPOSITIONS CONTAINING THICKENERS AND ABRASIVE MATERIALS

(75) Inventors: Alain Luciani, Saint-Georges-sur-Eure; Bernard Antelme, Saint-Piat; Sylvie Fauvet, Luisant; Vincent Manget, Neron; Jean-Francois Lhoste, le Coudray, all of (FR)

(73) Assignee: Reckitt & Colman SA, Massy Cedex (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/714,312

(22) Filed: Sep. 18, 1996

(30) Foreign Application Priority Data

Sep. 19, 1995 (GB) ..... 9519110

(51) Int. Cl.[7] ..... C11D 3/37; C11D 3/14; C11D 3/395

(52) U.S. Cl. ..... 510/238; 510/191; 510/239; 510/395; 510/398; 510/434; 510/475; 510/507

(58) Field of Search ..... 510/238, 239, 510/191, 434, 475, 398, 507, 395; 134/40, 42

(56) References Cited

U.S. PATENT DOCUMENTS

| | | | | |
|---|---|---|---|---|
| 3,968,047 | * | 7/1976 | Smeets | 252/95 |
| 3,985,668 | * | 10/1976 | Hartman | 252/99 |
| 4,005,027 | * | 1/1977 | Hartman | 252/95 |
| 4,051,055 | * | 9/1977 | Trinh et al. | 252/95 |
| 4,051,056 | * | 9/1977 | Hartman | 252/99 |
| 4,116,851 | * | 9/1978 | Rupe et al. | 252/103 |
| 4,235,732 | * | 11/1980 | Beyer | 252/103 |
| 4,240,919 | * | 12/1980 | Chapman | 252/95 |
| 4,248,728 | * | 2/1981 | Puryear | 252/103 |
| 4,287,079 | * | 9/1981 | Robinson | 252/99 |
| 4,352,678 | * | 10/1982 | Jones et al. | 51/307 |
| 4,438,016 | | 3/1984 | Kiewert et al. | 252/174.25 |
| 4,599,186 | * | 7/1986 | Choy et al. | 252/102 |
| 4,657,692 | * | 4/1987 | Choy et al. | 252/99 |
| 5,279,755 | * | 1/1994 | Choy et al. | 252/76 |
| 5,348,682 | * | 9/1994 | Finley et al. | 252/186.36 |
| 5,470,499 | * | 11/1995 | Choy et al. | 252/99 |
| 5,639,722 | * | 6/1997 | Kong et al. | 510/191 |

FOREIGN PATENT DOCUMENTS

| | | | | |
|---|---|---|---|---|
| 0 003 625 A1 | | 8/1979 | (EP) | C11D/1/14 |
| 407187 | * | 1/1991 | (EP) . | |
| 0 407 187 A3 | | 1/1991 | (EP) | C11D/3/12 |
| 606707 | * | 7/1994 | (EP) . | |
| 0 649 898 A2 | | 4/1995 | (EP) | C11D/3/395 |
| 2 300 643 | | 11/1996 | (GB) | C11D/17/00 |
| 2 315 772 | | 2/1998 | (GB) | C11D/3/12 |
| WO95/08619 | | 3/1995 | (WO) | C11D/3/16 |

OTHER PUBLICATIONS

Derwent Abstract of JP61057695 (Lion Corp), Mar. 24, 1986.

Derwent Abstract of JP60184599 (Lion Corp), Sep. 20, 1985.

Derwent Abstract of JP60055100 (Wakyo Kagaku), Mar. 29, 1985.

Derwent Abstract of JP59036198 (Kao Corp), Feb. 28, 1984.

Copy of GB Search Report for GB 9519110.2 dated Nov. 27, 1996.

* cited by examiner

*Primary Examiner*—Yogendra N. Gupta
*Assistant Examiner*—Charles Boyer
(74) *Attorney, Agent, or Firm*—Fish & Richardson P.C.

(57) ABSTRACT

A cleaning composition comprises:

A) 1% to 10% w/w of a colloid-forming material,

B) 0.5% to 10% w/w of a polymeric thickener,

C) 1% to 60% w/w of abrasive particles, and

D) a bleaching agent.

Preferably, the colloid-forming material is a clay and the polymeric thickener is a copolymer of acrylic acid.

Such a composition can stably suspend the abrasive particles and has the desired rheological properties for a cleaning composition for use on hard surfaces such as ceramic bathroom fittings and toilets.

31 Claims, No Drawings

CLEANING COMPOSITIONS CONTAINING THICKENERS AND ABRASIVE MATERIALS

The present invention relates to cleaning compositions, and especially to cleaning compositions for use on hard surfaces such as ceramic bathroom fittings and toilets. In particular, the present invention relates to such cleaning compositions including an abrasive material and a bleaching agent, and having a desired rheology.

Cleaning compositions which include abrasive particles are well known in the art. The abrasive particles are included in such compositions to assist physically in the removal of soils and stains from the surfaces.

It is also well known to incorporate bleaching agents into cleaning compositions in order to provide the compositions with disinfectant and/or antimicrobial properties and to further assist in soil and stain removal.

A particular problem in formulating compositions including abrasive particles has been that of retaining the particles in suspension in the composition during storage of the composition prior to use. Various solutions to this problem have been proposed and some success has been claimed through adapting the rheological properties of the composition so that the composition has a high viscosity (which can retain the particles in suspension) until the composition is subjected to external forces, for example shear forces. Thus, the high viscosity is maintained during storage, but the viscosity is lowered on pouring or expelling the composition from the bottle in which it is stored. Examples of compositions of this general type and similar types may be seen in U.S. Pat. No. 5,279,755, EP 0606707, EP 0606712, EP 0206534, EP 0159923, EP 0009942, EP 0003625, GB 1495549, GB 1437857 and EP 0011984.

It is, however, desirable that, when the composition is dispensed from its storage container, the viscosity of the composition is maintained at a sufficiently high level to enable the composition to "cling" to a non-horizontal surface. In other words, the composition must have a sufficient dwell-time on the surface to enable the active components of the composition to have the desired effect. Some of the above-listed references also address this problem. Also, the rheological properties of the composition may be adapted so that the composition has a so-called "plastic" rheology, whereby the composition is thickened in order to maintain the abrasive particles in suspension, but remains flowable without the need for excessive shaking or agitation. Thus, a composition with "plastic" rheology remains easily dispensable from its storage container.

Many prior art compositions of the type described above have included buffering agents based on phosphates and their derivatives. These buffering agents are now considered to be damaging to the environment and it is desirable to provide compositions which avoid the use of phosphate buffers.

It has now been found surprisingly that a composition having desired rheological properties and which can stably suspend abrasive particles comprises:

A) A colloid-forming component, in particular a clay

B) a polymeric water-soluble thickener

C) abrasive particles, and

D) a bleaching agent with the balance being water and optional minor ingredients, such as perfumes and dyes.

Desirably, the composition will also include at least one water-soluble surfactant to enhance the cleaning properties of the composition.

Accordingly, the present invention provides a cleaning composition comprising:

A) 1% to 10% of a colloid-forming material

B) 0.5% to 10% of a polymeric thickener

C) 1% to 60% of abrasive particles, and

D) a bleaching agent.

In this specification, all concentrations are % w/w unless otherwise specified.

Preferred colloid-forming materials are clays such as smectite clays, bentonite, laponite and montmorillonite. Bentonite clays are especially preferred. Typically, bentonite clays will comprise about 58% silicon oxide, 25% aluminium oxide and 3% magnesium oxide, with minor amounts (less than 2%) of other oxides.

In preferred variations of the invention, the clay is present in an amount of 1% to 5%, especially 2% to 5%. A particularly preferred clay is Laviothix P1, obtainable from Laviosa Chimica Mineraria S.p.A., Livorno, Italy.

Without wishing to be bound by theory, it is believed that the thickening of the formulations of the invention occurs through the interaction of the polymeric thickener with the colloid-forming clay. In particular, it is believed that the polymeric chains of the polymeric thickener may occupy voids in the clay structure.

In principle, any bleach-stable polymeric thickener which interacts appropriately with the clay may be used in the present invention, although polymers with branched chains may be preferred because of their increased thickening interaction.

Particularly preferred polymeric thickeners are copolymers of acrylic acid, such as Acusol, in particular Acusol 810A. Acusol is available from Rohn & Haas Company. Another suitable polymeric thickener is Polygel D.A., which is available from 3V Sigma.

In particular preferred variations of the invention, the polymeric thickener is present in an amount of 0.5% to 5%.

In the compositions of the invention, the choice of abrasive particles is not limited and any suitable bleach-stable particles of appropriate particle size and abrasivity may be used. Examples of suitable abrasive particles include calcium carbonate, pumice stone, calcite, dolomite, feldspar, talc, alumina, silica, quartz, perlite, zirconium silicate and diatomaceous earth and organic materials such as melamine, resins such as urea formaldehyde resins, polyethylene beads and polyamide derivatives. Calcium carbonate is particularly preferred.

In preferred compositions, the abrasive particles are present in amounts of 1% to 30%, most preferably 2% to 15%.

The bleaching agent employed in the compositions of the invention is preferably a halogen-based bleach. Suitable examples include hypohalite, especially hypochlorite salts of the alkali and alkaline earth metals, especially sodium hypochlorite or potassium hypochlorite, haloamines, haloimines, haloimides, haloamides, isocyanurate derivatives such as potassium or sodium dichloroisocyanurate, trichlorocyanuric acid, dichlorodimethyl hydantoin, chlorobromo dimethyl hydantoin, N-chlorosulphamide, chloramine and chlorinated trisodium phosphate dodecahydrate. Sodium hypochlorite is especially preferred.

The bleaching agent is preferably present in an amount of not more than 15%, particularly not more than 13%, and most preferably not more than 9%. However, the actual amount of bleaching agent present in the composition will be determined in accordance with the amount of available chlorine which results. Hence, the above quoted amounts are for guidance only and the amount of bleaching agent required to provide a given amount of available chlorine can be determined by methods known to those skilled in the art.

Preferably, the level of available chlorine will be between 0.5% and 15%.

In addition to the above components, the compositions of the invention may further include surfactants in order to improve the cleaning properties of the composition. The surfactants must, of course, be bleach-stable and will also desirably provide an additional contribution to the thickening system, by interaction with the colloid-forming clay. Especially preferred are amine oxide type surfactants (which provide a useful level of foaming in use of the composition) and sodium lauryl sulphate. A preferred amine oxide surfactant which can be obtained under the trade name Aromox™ from Akzo Nobel is a cocodimethylamine oxide. Sodium lauryl sulphate is obtainable from Albright & Wilson under the trade name Empicol.

Other surfactants and surfactant blends may also, or alternatively, be incorporated into the compositions of the invention, of which example include alkyl ether sulphates, alkyl sulphates, dodecyl benzene sulphonate, paraffin sulphonates, xylene, cumene and toluene sulphonates, sulphosuccinates, carboxylate surfactants, carboxylic ether surfactants, alpha olefin sulphonates, carboxyamphoglycinates and derivatives thereof. These surfactants may generally be present in amounts of up to 10%, preferably up to 5% and especially 1% to 3%.

As is known in the art, the pH of a composition may have an effect on the particle size of particles in suspension, and hence on the stability of the suspension. It has been hypothesised that the pH may affect the surface charge on the particles. Thus, at acidic pH, the particles are protonated and carry a positive charge and the converse is true at alkaline pH. In the surface-charged state, the particles are less likely to be flocculated. At intermediate pH values, the particles may reach a state of zero charge, at which the particles are more likely to agglomerate, so that the average particle size increases and flocculation may occur.

In the present invention, it has been found that, where the abrasive particles are calcium carbonate, the calcium carbonate particles tend to flocculate at pH values of a liquid phase of less than about pH 5.5 and there is an increased tendency to flocculation at pH values of greater than about pH 12. In the case of a clay, it has been found that flocculation of the clay particles begins to occur only at pH values greater than about pH 11. When the above two components are formulated in compositions of the invention, together with the polymeric thickener, minimum particle sizes are found to occur at pH values of about pH 9 to pH 12, especially pH 10.5 to pH 11.5. In this respect, therefore, it is desirable that the compositions of the invention are adjusted to a pH within the above ranges. However, consideration must also be given to optimising the viscosity and bleach stability and, when these factors are taken into account, the preferred pH of the compositions of the invention is pH 13 to pH 14, particularly pH 13.4. Generally, sodium hydroxide will be added to the composition in order to adjust the pH, but other suitable pH-adjusting materials, as known in the art, may be used. The addition of the sodium hydroxide also serves to increase the electrolyte concentration, which can enhance the thickening capability of the polymeric thickener. The sodium hydroxide may be present in an amount of 0% to 20%, particularly 1% to 10%, and especially 1% to 4%.

The compositions of the invention can be adjusted to have a desired rheology by appropriate selection of the amounts of one or more of the sodium hydroxide, the clay and the acrylic polymer. Further, during information of the composition, increased stirring time will lead to an increase in viscosity. The compositions of the invention are thixotropic with a relatively low yield point. Thus, the compositions maintain a viscosity sufficient to suspend the abrasive particles whilst in storage prior to use, and are shear thinning to allow ejection of the composition from a bottle in use. The compositions of the invention regain a high viscosity after ejection and are thus able to "cling" to non-horizontal surfaces. Further, the compositions of the invention spread well on a hard surface because of an excellent surface wettability. Surface wettability can be measured by the contact angle of the composition on the surface, in accordance with methods known to those skilled in the art.

Other minor optional ingredients may also be present in the compositions of the invention, such as optical brighteners, dyes, pigments and perfumes. Optical brighteners such as titanium dioxide or other titanium derivatives may be present in amounts of up to 10%, preferably not more than 1%. Perfumes may be present in amounts of up to 1%, preferably up to 0.5%.

The following is an example of a preferred composition in accordance with the invention:

| | |
|---|---|
| Laviothix P1 | 2.7% |
| Acusol 810A | 1% |
| Durcal 15 ($CaCO_3$) | 5% |
| Sodium hypochlorite (15%) | ca 9% |
| Aromox DMM CD-W | 0.1% |
| Empicol LX28 | 2.5% |
| NaOH (50%) | 4% (2% active) |
| $TiO_2$ | 0.18% |
| Perfume | 0.07% |
| Dye | 1% |
| Water | balance |

All percentages herein are by weight.

The above preferred composition may be formulated in accordance with the following method:

Water is added to a vessel and stirred to create a vortex. The $TiO_2$ is added and the stirring continued in order to obtain a uniform dispersion, for example for 10 minutes. $CaCO_3$ is then added and again stirring is continued to achieve a uniform dispersion, suitably for 10 minutes, after which the Laviothix is added and stirring is continued for a further 30 minutes. Acusol is then added and stirring continued for about a further 10 minutes, at increased speed if necessary. To the above pre-mix, NaOH is added gradually. A lowering of the viscosity will be seen and the speed of the stirrer should be adjusted accordingly. The surfactants Empicol and Aromix) are then added and stirring continued for about a further 10 minutes, followed by addition of the sodium hypochlorite in an amount to achieve the desired level of available chlorine. Finally, the dye and perfume are added and the stirring is continued at a lower speed for about 5 minutes.

The above formation provides a yield point of the order of 3.6 Pa and a thixotropic area of 236 Pa/s. Thus, this information demonstrates excellent flowability from a bottle. Further, the formulation has a contact angle on a glazed surface of 13°, showing excellent wettability. In contrast, one thickened bleach currently on the market shows a yield point of 26.4 Pa, a thixotropic area of 6721 Pa/s and a contact angle of 33°.

What is claimed is:

1. A cleaning composition which comprises:

A) 1% to 10% w/w of a colloid-forming material;

B) 0.5 to 10% w/w of a water-soluble polymeric thickener; which together with the colloid-forming material forms a thickening system;

C) 1% to 60% w/w of abrasive particles; and

D) a halogen-based bleaching agent, with the balance being water and optionally, other ingredients.

2. A composition according to claim 1, wherein the colloid-forming material is present in an amount of 1% to 5% w/w.

3. A composition according to claim 2, wherein the colloid-forming material is present in an amount of 2% to 5% w/w.

4. A composition according to claim 1, wherein the water-soluble polymeric thickener is present in an amount of 0.5% to 5% w/w.

5. A composition according to claim 1, wherein the abrasive particles are present in amounts of 1% to 30% w/w.

6. A composition according to claim 5, wherein the abrasive particles are present in an amount of 2% to 15% w/w.

7. A composition according to claim 1, wherein the colloid-forming material is selected from the group consisting of: smectite clay, bentonite clay, laponite clay, montmorillonite clay and mixtures thereof.

8. A composition according to claim 1, wherein the water-soluble polymeric thickener is an acrylic acid copolymer.

9. A composition according to claim 1, wherein the abrasive particles are selected from the group consisting of: calcium carbonate, pumice, calcite, dolomite, feldspar, talc, alumina, silica, quartz, perlite, zirconium silicate and diatomaceous earth.

10. A composition according to claim 9, wherein the abrasive particles are calcium carbonate particles.

11. A composition according to claim 1, wherein the abrasive particles are selected from the group consisting of: organic materials such as melamine, resins such as urea formaldehyde resins, polyethylene beads and polyamide derivatives.

12. A composition according to claim 1, wherein the halogen-based bleaching agent is one or more halogen-based bleaching agent selected from: hypohalites, haloamines, haloimines, haloimides, haloamides, isocyanurate derivatives, trichlorocyanuric acid, dichlorodimethyl hydantoin, chlorobromo dimethyl hydantoin, N-chlorosulphamide, chloramine and chlorinated trisodium phosphate dodecahydrate.

13. A composition according to claim 12, wherein the halogen-based bleaching agent is a hypohalite.

14. A composition according to claim 13, wherein the hypohalite is an alkali metal hypochlorite salt or an alkaline earth metal hypochlorite salt.

15. A composition according to claim 1, wherein the halogen-based bleaching agent is present in a sufficient amount in order to provide to the composition available chlorine in an amount of from 0.5% to 15% w/w.

16. A composition according to claim 15, wherein the halogen-based bleaching agent is an isocyanurate derivative.

17. A composition according to claim 16, wherein the isocyanurate derivative is selected from potassium dichloroisocyanurate and sodium dichloroisocyanurate.

18. A composition according to claim 1, which further includes other one or more constituents selected from surfactants, optical brighteners, dyes, pigments and perfumes.

19. A composition according to claim 1, which includes an amine oxide surfactant not in excess of 10% w/w.

20. A composition according to claim 1, which includes one or more surfactants selected from: alkyl ether sulphates, alkyl sulphates, dodecyl benzene sulphonate paraffin sulphonates, xylene sulphonates, cumene sulphonates, toluene sulphonates, sulphosuccinates, carboxylates, carboxylic ethers, alpha olefin sulphonates, carboxyamphoglycinates and derivatives thereof, present in an amount not in excess of 10% w/w.

21. A composition according to claim 1, which includes one or more optical brighteners in an amount not in excess of 10% w/w.

22. A composition according to claim 1, which includes one or more perfumes in an amount not in excess of 1% w/w.

23. A composition according to claim 1 having a pH of 13–14.

24. A process for cleaning a hard surface which comprises the step of applying a cleaning effective amount of the composition according to claim 1 to said hard surface.

25. A viscoelastic cleaning composition consisting essentially of:

A) 1% to 10% w/w of a colloid-forming material,

B) 0.5 to 10% w/w of a water-soluble polymeric thickener which together with the colloid-forming material forms a thickening system;

C) 1% to 60% w/w of abrasive particles, and

D) a hypohalite-based bleaching agent with the balance being water and optionally, other ingredients.

26. A viscoelastic cleaning composition consists essentially of:

A) 1% to 10% w/w of a bentonite clay,

B) 0.5 to 10% w/w of a polymeric thickener based on an acrylic acid copolymer, which together with the colloid-forming material forms a thickening system:

C) 1% to 60% w/w of calcium carbonate, and

D) sodium hypochlorite in a sufficient amount in order to provide to the composition available chlorine in an amount of from 0.5% to 15% w/w, cocodimethylamine oxide, sodium lauryl sulfate, with the balance being water and optionally, other ingredients.

27. A composition according to claim 23 having a pH of about 13.4.

28. A composition according to claim 25 having a pH of 13–14.

29. A composition according to claim 28 having a pH of about 13.4.

30. A composition according to claim 26 having a pH of 13–14.

31. A composition according to claim 30 having a pH of about 13.4.

* * * * *